United States Patent [19]

Kern et al.

[11] 4,010,799

[45] Mar. 8, 1977

[54] METHOD FOR REDUCING POWER LOSS ASSOCIATED WITH ELECTRICAL HEATING OF A SUBTERRANEAN FORMATION

[75] Inventors: Loyd R. Kern, Irving; Thomas K. Perkins, Dallas, both of Tex.

[73] Assignees: Petro-Canada Exploration Inc., Calgary; Imperial Oil Limited, Toronto; Canada-Cities Service, Ltd., Calgary, all of Canada

[22] Filed: Sept. 15, 1975

[21] Appl. No.: 540,434

[52] U.S. Cl. ..... 166/248; 166/60

[51] Int. Cl.[2] ..... E21B 43/24

[58] Field of Search ..... 166/248, 60, 65; 321/2, 321/4, 60; 307/147; 174/47, 108, 115

[56] References Cited

UNITED STATES PATENTS

| | | | |
|---|---|---|---|
| 2,131,585 | 9/1938 | Curtis | 321/60 |
| 2,748,868 | 6/1956 | Carpenter | 166/60 |
| 3,507,330 | 4/1970 | Gill | 166/248 |
| 3,594,492 | 7/1971 | Edison et al. | 174/108 X |
| 3,829,707 | 8/1974 | Pflanz | 307/147 |

OTHER PUBLICATIONS

"Composite Catalog of Oil Field Equipment & Services", 25th Rev., vol. 1, 1962–1963, World Oil (Gulf Publishing Co.), Houston, Texas, p. 197.

*Primary Examiner*—Stephen J. Novosad
*Attorney, Agent, or Firm*—Ronnie D. Wilson

[57] ABSTRACT

Method for reducing the loss of power accompanying the transmission of electrical energy down a wellbore to heat a subterranean formation via electrical conduction between a plurality of wells completed therein, characterized by providing a low frequency alternating current to the conductors in the wellbore. Also disclosed are specific embodiments of the invention.

1 Claim, 1 Drawing Figure

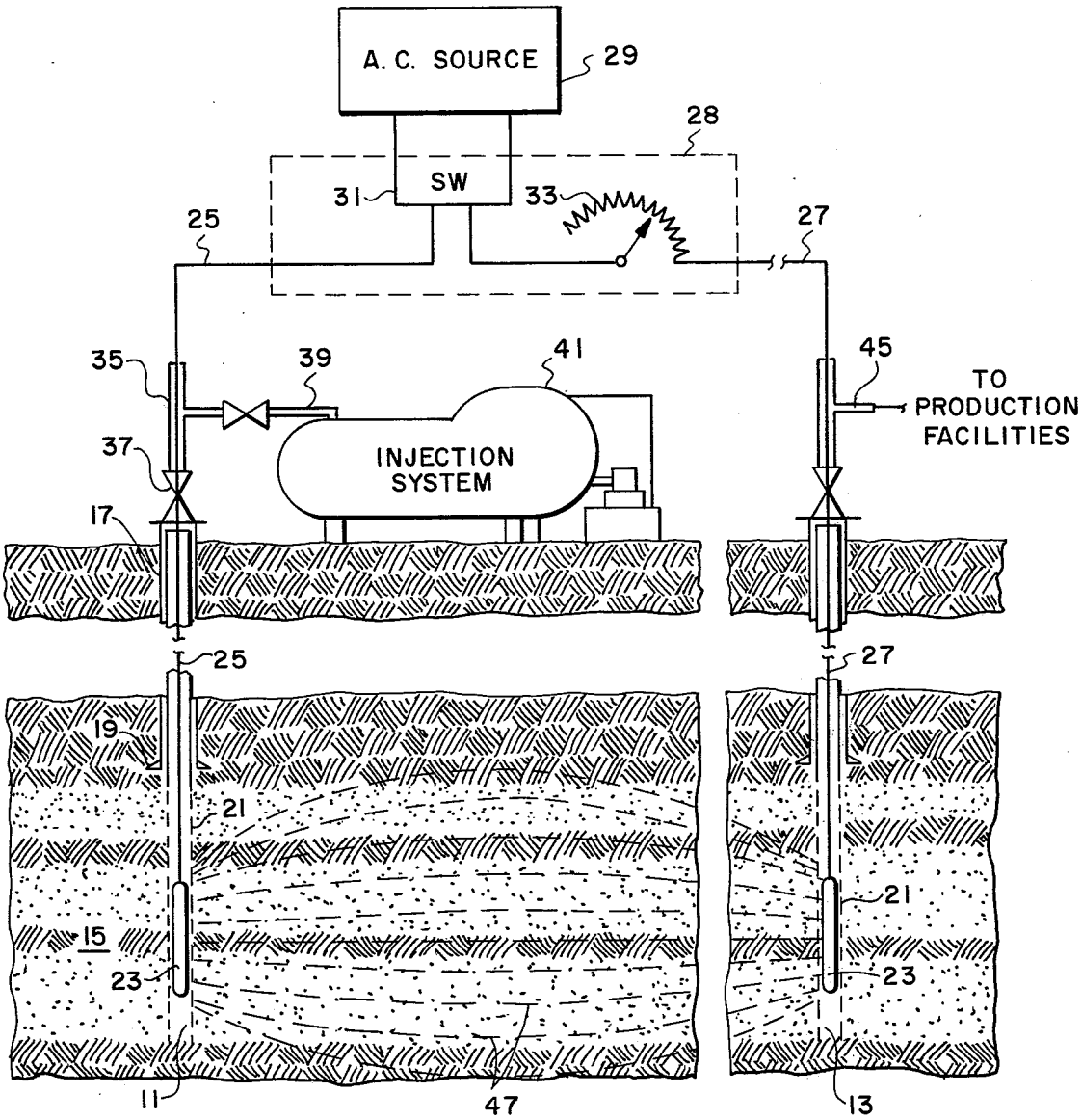
A. C. SOURCE
29
28
SW
31
33
25
27
35
39
41
45
TO PRODUCTION FACILITIES
37
INJECTION SYSTEM
17
25
27
19
21
21
15
23
23
11
47
13

METHOD FOR REDUCING POWER LOSS ASSOCIATED WITH ELECTRICAL HEATING OF A SUBTERRANEAN FORMATION

This invention relates to a method for the electrical heating of a subterranean formation. More particularly, the present invention is concerned with the reduction of the power losses associated with the transmission of electrical energy down a wellbore to effect the heating of a formation via electrical conduction between a plurality of wells completed therein.

There is a considerable body of prior art relating to the general field of so-called electrothermic processes for raising the temperature of hydrocarbonaceous subterranean formations, all of which rely upon the electrical conductivity of the formation. Known techniques typically involve sinking a well into the formation having an electrode positioned near its bottom in electrical contact with the formation. The electrode is formed as part of an alternating current circuit extending through the wellbore from the surface with the circuit being completed through the formation.

This large body of prior art discloses very little information which is concerned with the loss of power in the transmission thereof between voltage sources and downhole electrodes. The efficiency with which an electrical heating effect is provided in a formation is dependent upon producing electric power at the electrodes. Accordingly, it has been previously recognized that it is most desirable to provide good conductive paths between voltage sources and electrodes to obviate any unnecessary voltage losses; and also to insulate against any extraneous current paths which would carry the flow of current outside the desired paths. The prior art does disclose various insulating means to aid in lowering power losses. For example, insulating tubing, casing fluids, and coatings which act as barriers or shields have all been disclosed as means for defining a conducting path for the current.

However, it has been found that while transmitting power downhole in an electrical heating operation a considerable amount of the power is lost due to the magnetic hysteresis effect and the induced eddy current in the casing. The use of insulating casing, tubing, fluids, and coatings aid in the reduction of this loss but by no means eliminate it. Further, the use of insulating materials such as fiberglass, epoxy coatings and the like present their own problems in regard to lack of strength and their lack of ability to withstand high temperature.

Accordingly, it is an object of this invention to provide a method for heating electrically a subterranean formation.

A further object is to provide an efficient and economical method for transmitting power downhole in order to electrically heat a subterranean formation.

It is another object of this invention to provide a method for minimizing the power loss which occurs when transmitting electrical energy down a wellbore to heat a subterranean formation.

These and other objects will become apparent from the following descriptive matter, particularly when taken in conjunction with the appended claims.

In accordance with this invention, a subterranean formation intermediate a plurality of wells completed therein is heated via electrical conduction by passing a low frequency alternating current through the conductors in the wellbore significantly reducing the power losses associated with the transmission of the electrical energy down the wellbore.

It has been found that when transmitting power downhole in an electrical heating operation, as a result of using 60 cycle alternating current, considerable power is lost through induced eddy currents in the conductors and magnetic hysteresis. As a piece of steel is alternately magnetized and demagnetized, energy is dissipated and converted to heat due to the hysteresis loop resulting in a net power loss in the system. It has also been found that this loss can be as great or better than 10% of the total power carried by the conductor downhole. The present invention provides a method for significantly reducing this power loss to only as much as 10% of what the loss would be otherwise. The utilization of alternating current is preferred in order to reduce the effects of electrode corrosion and polarization which accompany the use of direct current.

The FIGURE is a side elevational view, partly schematic and partly in section, illustrating one simplified embodiment of this invention.

Referring to the FIGURE a plurality of wells 11 and 13 have been drilled into and completed within a subterranean formation 15. Each of the wells 11 and 13 have been completed so they may be operated as either injection or production wells. Specifically, the wells have a string of casing 17 that is inserted in the drilled bore hole and cemented in place with the usual foot 19. A perforate conduit 21 extends into the subterranean formation 15 adjacent the periphery of the wellbore that was drilled thereinto. Preferably, the casing 17 includes a lower electrically insulated conduit for constraining the electrical current flow to the subterranean formation as much as practical. The perforate conduit 21 may be casing having the same or a different diameter from casing 19, or it may be large diameter tubing inserted through the casing 19. As illustrated, the perforate conduit 21 comprises a separate string of conduit extended from the surface for better preserving the heat content of an injected immiscible fluid.

Each of the wells 11 and 13 has an electrode 23. The respective electrodes 23 are connected via electrical conductors 25 and 27 with surface equipment 28 and a source of electrical current, illustrated as alternating current (A.C.) source 29. The eletrical conductors 25 and 27 are insulated between the electrodes 23 and the surface equipment. The surface equipment 28 includes suitable controls that are employed to effect the predetermined current flow. For example, a switch (SW) 31 and voltage control means, such as rheostat 33, are illustrated for controlling the duration and magnitude of the current flow between the electrodes 23 in the wells 11 and 13 by way of the subterranean formation 15. It is preferred that the alternating current source 29 be adjusted to provide the correct voltage for effecting the current flow through the subterranean formation 15 without requiring much power loss in surface control equipment, exemplified by rheostat 33. The respective electrical conductors 25 and 27 are emplaced in their respective wells 11 and 13 with conventional means. As illustrated, they are run through lubricators 35 in order to allow alternate or simultaneous heating, and injection and production, without having to alter the surface accessories, such as changing the configuration of the well head 37, with its valves and the like.

As illustrated, the well 11 is connected with an immiscible fluid injection system by way of suitable insulated surface conduit 39. The illustrated fluid injection system comprises a storage tank for injecting fluid which has a specific resistivity less than that of the connate water in place. The injection system 41 is constructed and operated in accordance with conventional engineering technology that does not, per se, form part of this invention and is well known and is not described in detail herein. The conventional injection system technology is contained in a number of printed publications which are incorporated herein by reference for details.

The perforate conduit 21 in well 13 is connected to surface production facilities by way of a second surface conduit 45. The production facilities are those normally employed for handling normally viscous crude oils and are not shown, since they are well known in the art. The production facilities include such conventional apparatus as heater treaters, separators, and heated storage tanks, as well as the requisite pumping and flow facilities for handling the oil. The production facilities also are connected with suitable conventional oil processing facilities (also not shown), such as are employed in the conventional processing of the oil after it is recovered from the formation by surface mining techniques, or otherwise. Since these production and processing facilities do not, per se, form a part of this invention, they are not described in detail herein.

In operation, the wells 11 and 13 are completed in the formation 15 in accordance with conventional technology. Specifically, bore holes are drilled, at the desired distance and patterning, from the surface into the subterranean formation 15. Thereafter, the casing 17 is set into the formation to the desired depth. As illustrated, the casing 17 may comprise a surface string that is cemented into place immediately above the formation. Thereafter, a second string of casing, including an insulated perforate conduit 21, is emplaced in the respective bore holes and completed in accordance with the desired construction. For example, a perforate conduit 21 may have its foot cemented in place, or it may be installed with a gravel pack or the like to allow for expansion and contraction and still secure the desired injectivity and productivity.

In any event, the electrodes are thereafter placed in respective wells. For example, the formation may be from 100 to 300 feet thick and the respective electrodes 23 may be from 50 to 100 feet or more in length. The electrodes 23 are continuously conductive along their length and are connected with the respective electrical conductors 25 and 27 by conventional techniques. For example, the electrodes 23 may be of copper based alloy and may be connected with copper based conductors 25 and 27 by suitable copper based electrical connectors. Thereafter, the alternating current source 29 is connected with the conductors 25 and 27 by way of the surface control equipment, illustrated simply as switch 31 and rheostat 33. If the desired current densities are obtainable without the use of the rheostat, it is set on the zero resistance position to obtain the desired current flow between the wells. The electrical current will flow primarily through the formation, although some of the electrical energy will flow through the oil-impermeable shales, as illustrated in the dashed lines 47. In one embodiment of the present invention the low frequency alternating current utilized herein is provided by a low frequency generator.

In another embodiment, the low frequency alternating current is provided by using a frequency convertor to convert high frequency alternating current to a low frequency alternating current.

In still another embodiment low frequency alternating current is provided by generating a direct current and reversing the direction thereof in a periodic manner with suitable switching means to produce a current approaching a "square wave" rather than a sinusoidal wave of ordinary alternating current. In this manner a commercially available alternator of 60 cycles, for example, could be utilized to produce a square wave with a frequency of only a few cycles per second or less. The direct current could also be provided by rectifying an alternating current. In order to produce a current approaching a square wave the time interval between reversals in current direction should be equal (symmetrical). A solid-state switching device would be suitable for accomplishing this reversal of current direction.

The low frequency alternating current of the present invention regardless of means through which it is provided should have a frequency of less than 60 cycles per second in order to achieve reduction in power loss. The lower the frequency the greater the reduction in power loss that will be achieved. However, at the extremely low frequencies of less than about 0.10 cycles per second, problems of corrosion and polarization associated with the use of direct current again begin to enter into the operation to reduce the advantages thereof. At a frequency of from about 0.10 to about 5.0 cycles per second the largest reduction in power loss is achievable.

By taking advantage of the fact that the power losses resulting from induced voltage and hysteresis are directly related to the frequency, the present invention has the overall effect to drastically reduce the loss of power associated with transmitting power downhole to electrically heat a formation. Such a reduction in power loss is extremely critical to the overall efficient and economic performance of a system whereby a subterranean formation is heated via electrical conduction between a plurality of wells completed therein.

The following example illustrates the applicability of the invention in lowering the power loss associated with the transmission of power downhole.

Example 1000 feet, copper cable
270 amperes
1000 feet, 7-inch steelcasing having a Brinell hardness of 188

| frequency, cycles per second | magnetic hysteresis and eddy current power loss, watts | reduction in power loss, % |
|---|---|---|
| 60 | 15360 | |
| 40 | 11280 | 26.6 |
| 20 | 8400 | 45.4 |
| 10 | 5280 | 65.7 |
| 5 | 3360 | 78.2 |
| 2 | 1340 | 91.3 |

Utilizing a commercial generator powered by a diesel engine the low frequency alternating current is transmitted down a wellbore through a copper cable running the length of a 1000 foot seven-inch steel casing. The varying frequency is achieved by varying the speed of the generator. The very low frequencies are provided by gearing down the generator to very low speeds. As can readily be seen from the above table, utilization of low frequency alternating current significantly reduces the power loss associated with transmitting power down a wellbore as a result of induced eddy currents and magnetic hysteresis. Power loss to cable is not included in this example. The particular size cable used determines that amount of loss. However, regardless of the size of cable utilized, the use of low frequency alternating current will significantly reduce induced eddy current and magnetic hysteresis loss when compared to the use of high frequency alternating current.

It should be noted that when employing the present invention to heat a subterranean formation via electrical conduction between, for example, two wells completed therein, the reduction in power loss illustrated by the above example will be approximately twice that shown because of the circuit being completed through the formation and up the second wellbore. Power losses in the second well will also be reduced an equivalent amount by the use of low frequency alternating current.

Having thus described the invention, it will be understood that such description has been given by way of illustration and not by way of limitation, reference for the latter purpose being has to the appended claims.

We claim:

1. Method of reducing power losses associated with transmission of electrical energy down a wellbore to heat a subterranean formation via electrical conduction between a plurality of wells completed therein, which comprises, passing an alternating current having a frequency of from about 0.10 to about 5.0 cycles per second through the conductors in said wellbore.

* * * * *